US008523577B1

(12) United States Patent
Huang et al.

(10) Patent No.: US 8,523,577 B1
(45) Date of Patent: Sep. 3, 2013

(54) ELECTRICAL CONNECTOR

(75) Inventors: Guang-Li Huang, Guang-Dong (CN); Yin-Lung Wu, New Taipei (TW); Ming-Chiang Chen, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 30 days.

(21) Appl. No.: 13/398,827

(22) Filed: Feb. 16, 2012

(51) Int. Cl.
*H01R 11/30* (2006.01)

(52) U.S. Cl.
USPC ..... 439/39

(58) Field of Classification Search
USPC ..... 439/39, 607.01, 607.34, 712, 218
See application file for complete search history.

(56) References Cited

U.S. PATENT DOCUMENTS

D236,481 S * 8/1975 Johnston ..... D13/156
7,097,461 B2 * 8/2006 Neidlein ..... 439/66
7,311,526 B2 * 12/2007 Rohrbach et al. ..... 439/39
7,528,736 B2 * 5/2009 Hall et al. ..... 340/854.9
7,566,224 B2 * 7/2009 Wu ..... 439/39
8,052,470 B1 * 11/2011 Lin ..... 439/607.01
8,083,548 B1 * 12/2011 Lin ..... 439/607.34
8,152,533 B1 * 4/2012 Lin ..... 439/39
D663,696 S * 7/2012 Huang et al. ..... D13/147
8,241,043 B1 * 8/2012 Lin ..... 439/39
8,388,354 B1 * 3/2013 Lin et al. ..... 439/39
2007/0161262 A1 * 7/2007 Lloyd ..... 439/39

* cited by examiner

*Primary Examiner* — Alexander Gilman
(74) *Attorney, Agent, or Firm* — Cheng-Ju Chiang

(57) ABSTRACT

An electrical connector includes an insulating housing having a base body of which a front surface is inclined to act as a mating face. The mating face is concaved rearward to define a plurality of terminal grooves penetrating through the base body and a plurality of receiving grooves of substantial U-shape each surrounding one of the terminal grooves. Wherein there are some terminal grooves without being surrounded by any receiving grooves and each of them is located between every two adjacent receiving grooves. A plurality of terminals is inserted forward in the terminal grooves of the insulating housing respectively. Each terminal has a contact end exposed outside through a front end of the corresponding terminal groove. A plurality of magnet units each is of substantial U-shape and is assembled in the receiving groove of the insulating housing.

8 Claims, 3 Drawing Sheets

ELECTRICAL CONNECTOR

BACKGROUND OF THE INVENTION

1. Field of the Invention

The present invention relates to an electrical connector, and more particularly to an electrical connector adapted for connecting with a mated connector by virtue of magnetic attraction.

2. The Related Art

With the development of electronic technology, electrical connectors are widely used in electronic products. A traditional electrical connector connected with a mated connector by magnetic attraction generally includes an insulating housing, a plurality of terminals and a plurality of magnet units assembled in the insulating housing respectively. In use, the interconnection between the electrical connector and the mated connector is apt to be influenced by the magnetic force of the magnet units. However, the size of the magnet unit often affects the magnetic force of the electrical connector. Moreover, the rapid developments of the electronic products call for more stringent requirements to miniaturization of the electrical connectors. As a result, the traditional electrical connector generally fails to meet the requirements of both miniaturization and strong magnetic force at the same time.

SUMMARY OF THE INVENTION

Accordingly, an object of the present invention is to provide an electrical connector. The electrical connector includes an insulating housing having a base body of which a front surface is inclined to act as a mating face. The mating face is concaved rearward to define a plurality of terminal grooves penetrating through the base body and a plurality of receiving grooves of substantial U-shape each surrounding one of the terminal grooves. Wherein there are some terminal grooves without being surrounded by any receiving grooves and each of them is located between every two adjacent receiving grooves. A plurality of terminals inserted forward in the terminal grooves of the insulating housing respectively. Each terminal has a contact end exposed outside through a front end of the corresponding terminal groove. A plurality of magnet units each is of substantial U-shape and is assembled in the receiving groove of the insulating housing.

As described above, each of the magnet units is of substantial U-shape and is assembled in the corresponding receiving groove of substantial U-shape to surround the corresponding terminal, so that is in favor of enlarging the size of the magnet unit so as to reinforce the magnetic attraction between the electrical connector and a mated connector, even though it is under the circumstances of no affecting the miniaturization of the electrical connector. Therefore, the electrical connector can meet the requirements of both miniaturization and strong magnetic force at the same time.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
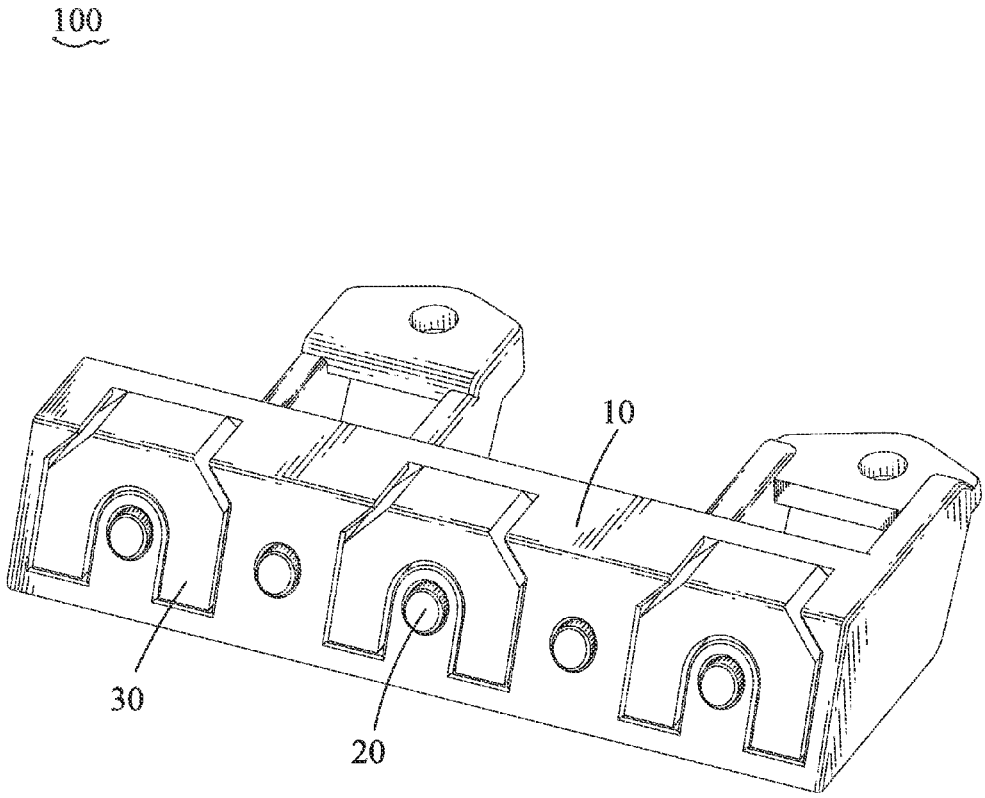
FIG. 1 is an assembled perspective view of an electrical connector in accordance with an embodiment of the present invention.
Figure 2:
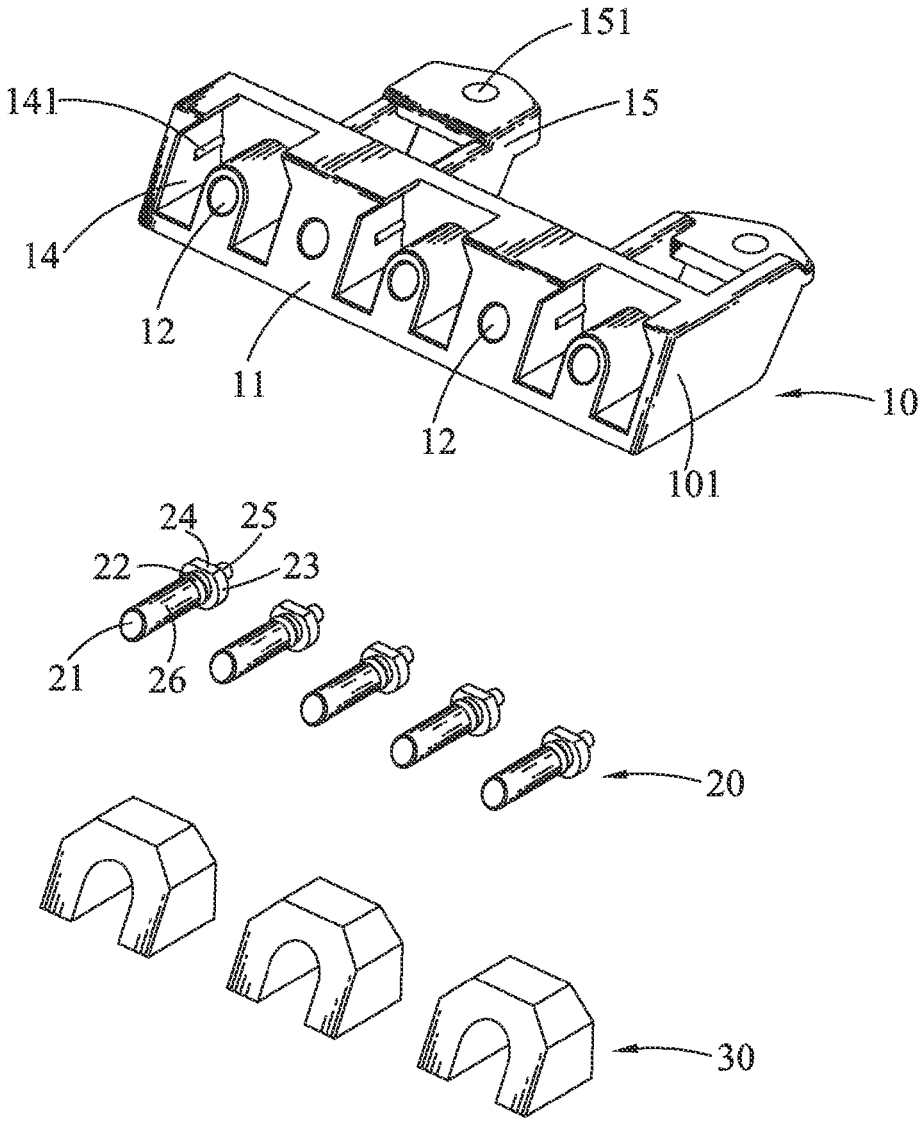
FIG. 2 is an exploded perspective view of the electrical connector shown in FIG. 1.

Referring to FIGS. 1-2, an electrical connector 100 according to an embodiment of the present invention includes an insulating housing 10, a plurality of terminals 20 and a plurality of magnet units 30 assembled in the insulating housing 10.

Figure 3:
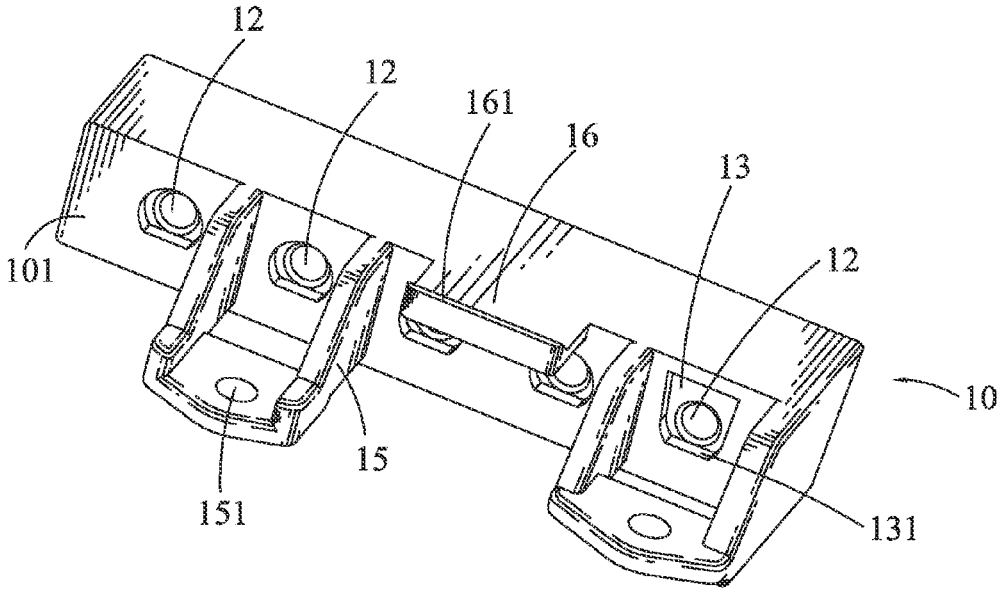
FIG. 3 is a perspective view of an insulating housing of the electrical connector shown in FIG. 1.

Referring to FIG. 2 and FIG. 3, the insulating housing 10 has a base body 101 of which a front surface is inclined to act as a mating face 11. The mating face 11 is concaved rearward to define a plurality of terminal grooves 12 penetrating through the base body 101 and a plurality of receiving grooves 14 of substantial U-shape each surrounding one of the terminal grooves 12. Wherein there are some terminal grooves 12 without being surrounded by any receiving grooves 14 and each of them is located between every two adjacent receiving grooves 14. An inner sidewall of the receiving groove 14 defines an interfering rib 141. A rear end of each terminal groove 12 is spread outward to form a positioning fillister 13. An inner sidewall of the positioning fillister 13 shows a flat shape and is acted as a foolproof wall 131. A rear surface of the base body 101 protrudes rearward to form at least one locating portion 15 with a locating hole 151 opened therein, and a tongue board 16 with a buckle portion 161 protruding therefrom.

Referring to FIG. 1 and FIG. 2, the terminals 20 are inserted forward in the terminal grooves 12 of the insulating housing 10 respectively. Each terminal 20 has a contact end 21 exposed outside through a front end of the corresponding terminal groove 12. Each of the terminals 20 has a cylindrical connecting portion 26 inserted forward in the terminal groove 12. A front end of the connecting portion 26 is slantwise designed to form the contact end 21. A rear end of the connecting portion 26 protrudes outward to form a blocking portion 23 positioned in the positioning fillister 13, and protrudes rearward to form a soldering portion 25 stretching behind the base body 101. A part of the blocking portion 23 corresponding to the foolproof wall 131 is cut off to form a foolproof face 24 cooperating with the foolproof wall 131 to avoid mis-inserting the terminal 20 in the terminal groove 12 and further ensure the contact end 21 of the terminal 20 and the mating face 11 of the insulating housing 10 in the same inclined plane. An outer periphery of the connecting portion 26 protrudes outward to form a fastening portion 22 interfering with an inner periphery of the corresponding terminal groove 12 to secure the terminal 20 in the terminal groove 12.

Referring to FIG. 1 and FIG. 2, each of the magnet units 30 is of substantial U-shape and steadily assembled in the corresponding receiving groove 14 of the insulating housing 10 by interfering with the interfering rib 141. A front side (not labeled) of the magnet unit 30 is inclined to make the contact ends 21 of the terminals 20, the mating face 11 of the base body 101 and the front sides of the magnet units 30 located in the same inclined plane.

As described above, each of the magnet units 30 is of substantial U-shape and is assembled in the corresponding receiving groove 14 of substantial U-shape to surround the corresponding terminal 20, so that is in favor of enlarging the size of the magnet unit 30 so as to reinforce the magnetic attraction between the electrical connector 100 and a mated connector (not shown), even though it is under the circumstances of no affecting the miniaturization of the electrical connector 100. Therefore, the electrical connector 100 can meet the requirements of both miniaturization and strong magnetic force at the same time.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector, comprising:

an insulating housing having a base body of which a front surface is inclined to act as a mating face, the mating face being concaved rearward to define a plurality of terminal grooves penetrating through the base body and a plurality of receiving grooves of substantial U-shape each surrounding one of the terminal grooves, wherein there are some terminal grooves without being surrounded by any receiving grooves and each of them is located between every two adjacent receiving grooves;

a plurality of terminals inserted forward in the terminal grooves of the insulating housing respectively, each terminal having a contact end exposed outside through a front end of the corresponding terminal groove; and a plurality of magnet units of which each is of substantial U-shape being assembled in the receiving groove of the insulating housing.

2. The electrical connector as claimed in claim 1, wherein an inner sidewall of the receiving groove defines an interfering rib, the magnet unit is steadily assembled in the corresponding receiving groove of the insulating housing by interfering with the interfering rib.

3. The electrical connector as claimed in claim 1, wherein each of the terminals has a cylindrical connecting portion inserted forward in the terminal groove, a front end of the connecting portion is slantwise designed to form the contact end, a front side of the magnet unit is inclined to make the contact ends of the terminals, the mating face of the base body and the front sides of the magnet units located in the same inclined plane.

4. The electrical connector as claimed in claim 3, wherein a rear end of each terminal groove is spread outward to form a positioning fillister, a rear end of the connecting portion protrudes outward to form a blocking portion positioned in the positioning fillister, and protrudes rearward to form a soldering portion stretching behind the base body.

5. The electrical connector as claimed in claim 4, wherein an inner sidewall of the positioning fillister shows a flat shape and is acted as a foolproof wall, a part of the blocking portion corresponding to the foolproof wall is cut off to form a foolproof face cooperating with the foolproof wall to avoid misinserting the terminal in the terminal groove and further ensure the contact end of the terminal and the mating face of the insulating housing in the same inclined plane.

6. The electrical connector as claimed in claim 4, wherein an outer periphery of the connecting portion protrudes outward to form a fastening portion interfering with an inner periphery of the corresponding terminal groove to secure the terminal in the terminal groove.

7. The electrical connector as claimed in claim 1, wherein a rear surface of the base body protrudes rearward to form at least one locating portion with a locating hole opened therein.

8. The electrical connector as claimed in claim 1, wherein a rear surface of the base body protrudes rearward to form a tongue board with a buckle portion protruding therefrom.

* * * * *